United States Patent [19]

Nishiwaki

[11] Patent Number: 4,818,573

[45] Date of Patent: Apr. 4, 1989

[54] PROCESS FOR THE WATERPROOF WORKING WITH THE USE OF DEPOSITION LAYER INCLUDING MESH REINFORCING BAR

[75] Inventor: Kokichi Nishiwaki, Tokyo, Japan

[73] Assignee: Kabushikikaisha Toshonishiwaki, Japan

[21] Appl. No.: 102,293

[22] Filed: Sep. 25, 1987

Related U.S. Application Data

[63] Continuation of Ser. No. 863,143, May 14, 1986, abandoned.

[30] Foreign Application Priority Data

May 17, 1985 [JP] Japan ..... 60-103814

[51] Int. Cl.[4] ..... B05D 1/36; B05D 7/00; E04C 1/00; E04B 2/00

[52] U.S. Cl. ..... 427/403; 52/309.17; 156/71; 427/407.1

[58] Field of Search ..... 52/230, 231, 268, 309.12, 52/309.17, 414, 454, 515, 516, 517, 600, 612; 156/71; 427/403, 407.1

[56] References Cited

U.S. PATENT DOCUMENTS

| | | | |
|---|---|---|---|
| 3,956,864 | 5/1976 | Fung | 52/414 |
| 4,068,429 | 1/1978 | Moore | 52/309.17 X |
| 4,349,398 | 9/1982 | Kearns et al. | 427/403 X |
| 4,392,335 | 7/1983 | Heiman | 52/309.17 |

*Primary Examiner*—Michael Lusignan
*Attorney, Agent, or Firm*—Eric P. Schellin

[57] ABSTRACT

A process for the waterproof working with the use of deposition layer including mesh reinforcing bar comprises of depositing on under coat, at least on waterproof material layers and inserting a mesh reinforcing bar layer in any one between said waterproof material deposited layers. The process can be carried out the waterproof working for structures such as building, road and the like.

2 Claims, 1 Drawing Sheet

PROCESS FOR THE WATERPROOF WORKING WITH THE USE OF DEPOSITION LAYER INCLUDING MESH REINFORCING BAR

This application is a continuation, of application Ser. No. 863,143, filed May 14, 1986, now abandoned.

BACKGROUND OF THE INVENTION (1) Field of the Invention

The invention relates to a process for the waterproof working of a structure such as building, a structure of civil engineering such as road, stand and the like by depositing a mesh reinforcing bar layer in any one between waterproof material layers of rubber elastic cement, elastic mortar and polymer mortal.

(2) Description of the Prior Art

Generally, various waterproofs, for example asphalt waterproof, mortar waterproof, rubber sheet waterproof, urethane rubber-coating waterproof, acrylic rubbercoating waterproof and the like have been used in the waterproof working, and particularly the asphalt waterproof has been used preferably from old times. Recently, an emulsion type-resin waterproof has been used from a reason, which can be safely carried out the waterproof working, but said asphalt waterproof can be used advantageously more than said emulsion waterproof, because a durability of the asphalt waterproof will be excellent more than that of the emulsion waterproof. However, in the asphalt waterproof, the asphalt material had need to deposite usually in a thickness of about 5~10 mm, and further deposite on said asphalt material a press concrete layer (thickness: about 100~200 mm) and a protect mortar layer (thickness: about 40~50 mm) in order to obtain a waterproof function more than 10 years. When the asphalt material waterproof layer is not protected by the press concrete layer and the protect mortar layer, said asphalt layer would be degraded by external factors such as direct rays of the sun, and as the result, a life-time of the waterproof becomes very short. Particularly, when the waterproof layer is provided on various structures including for example a parking space, a roof, a floor which is installed heavy installation, a structure of civil engineering and a rooftop of building, the press concrete layer would be formed to very thick to the extent of about 100~200 mm, so that these structure themselves are suffered vast weight load, for example more than 250~500 Kg per area. Thus, this is one factor for accelerating the life-time of the structures.

Also, in the asphalt waterproof working, a concretedry aging after provided the under coat on a base surface of the structures requires over about one month in order to improve adhesion properties, so that a working time for the waterproof become in excess.

Furthermore, it has been utilized in prior art, a relatively thin waterproof material including a rubber elastic materials, but has not been yet developed a complete waterproof material, which is withstood against a crazing of the concrete base and has long-term waterproof function.

SUMMARY OF THE INVENTION

It has now been found in accordance with the present invention that the crazing producing from an interior portion of the concrete base of the structures was produced at an approximate value of tensile strength and flexural strength based on the following reason: that is, in consideration of tension stress of the concrete crazing, a development of said crazing can be determined by a stress calculation in direct before and after the produced strain, this influences on elasticity modulus and sectional area of steel stock and give in direct proportion to the tensile strength so that the tensile stress causes to about ½ of a compressive strength of the concrete base when crazed, and for example when applied a compressive strength of about 400 Kg to the concrete base, the tensile stress is about 40 $Kg/cm^2$ and the flexural strength is about 60 $Kg/cm^2$.

It is an object of the invention to provide a process for waterproof working which withstand to a crazing and cracking without producing a rupture by using new waterproof materials of rubber elastic cement, elastic mortar and polymer mortar and further mesh reinforcing bar. According to this process, the invention can be accomplished a complete waterproof working, which is prevented a flooding and a leaking of water by the crazing, the cracking, a expansion and the like of the concrete structure.

Upon this fact, the present invention has now been found that superior waterproof materials which are withstood the crazing and extented accompanying to said crazing can be used in combination with a mesh reinforcing bar layer to form integrally a complete waterproof layer in the construct.

In an embodiment of the process according to the present invention, the rubber elastic cement layer comprising a mix of the synthetic resin - or synthetic rubber-type emulsion and cement, and the mesh reinforcing bar layer can be integrally waterproofed through an under coat with the concrete base of the structure in a superposed construction.

In other embodiment according to the present invention, the elastic mortar and/or polymer mortal layers are produced by mixing a mix of the synthetic resin-type and synthetic rubber-type emulsion and the cement with aggregate and water, and these mortar layers can be integrally waterproofed together with the mesh reinforcing bar layer through the under coat on the concrete base in the superposed construction.

In a further modified embodiment according to the present invention, a complex waterproof formed by depositing the mesh reinforcing bar layer on any combination of the waterproof material layers of the rubber elastic cement, elastic mortar and polymer mortar in any one between said layers of waterproof materials can be integrally waterproofed through the under coat with the concrete base in the superposed construction.

The terms "rubber elastic cement", "elastic mortar" and "polymer mortar" described therein mean a cement and mortar as an inorganic material having high waterproof properties and fastness properties by applying the rubber elastic properties and stretching properties to the inorganic material in which the synthetic resin- or synthetic rubber-type emulsion is mixed with the inorganic material. Also, "polymer mortar" means a products defined by JIS standard.

The rubber elastic cement used in the process according to the present invention can be easily produced by mixing intimately the synthetic emulsion and the cement in a ratio of 1: 0.5~1 : 1, preferably 1: 0.8~1: 1 with the use of suitable mixer. When using said rubber elastic cement in cold weather land, which is easily formed the crazing, a mixing amount of the emulsion is preferably added in some large amount, for example in a ratio of emulsion 1 : cement 0.5~0.7. This increases the rubber resin content to compensate the decreasing of the elastic modulus influenced with low temperature.

The synthetic resin—or the synthetic rubber-type emulsion is an aqueous dispersing emulsion produced by dispersing intimately the synthetic resin or the synthetic rubber into substantial same amount or some excess amount of water. The synthetic resin—or synthetic rubber-type emulsion includes various kinds of emulsion such as for example acrylic-type synthetic resin emulsion, acrylic rubber emulsion, styrene-butadiene-type rubber emulsion, vinyl acetate- and ethylene acetate-type emulsion, chloropren-type rubber emulsion, asphalt emulsion, rubber-containing asphalt emulsion, polypropylene-type emulsion, uretane rubber-type emulsion, ethylene-vinyl chloride-type emulsion, epoxy resin-type emulsion, silicon rubber-type emulsion. Particularly, the acrylic-type synthetic resin emulsion is preferable as said emulsion. Thus, the present invention is explained mainly with regard to said emulsion, but this invention should not be limited thereby, said acrylic-type synthetic resin emulsion includes, for example acrylic resin, methyl methacrylate-ethyl acrylate copolymer, methylmethacrylate-butylacrylate copolymer, methylmethacrylate-2-ethylhexyl acrylate copolymer, methylmethacrylate-butadiene copolymer, styrene-ethylacrylate copolymer, styrene-butylacrylate copolymer and the like.

As described the above, the synthetic resin emulsion can be produced a rubber elastic cement having a consistency suitable in the waterproof working by mixing directly said emulsion with suitable amount of cement, since the emulsion itself includes a sufficient amount of water content. Thus, when producing the rubber elastic cement, the water content to be mixed can be regulated according to means for utilizing in the working, for example an atomizing (or spraying) or a spreading and the like.

According to the present invention, the cement can be used various kinds of cements, for example portland cement, high-early-strength cement, white cement, alumina cement, silica cement and the like, and gypsum, and particularly, the portland cement and white cement can be used preferably. In the use of the white cement, the rubber elastic cement, the elastic mortar and the polymer mortar, respectively can be colored to a desireable color by adding any pigment.

Furthermore, an accelerator for hydration reaction of the cement, a leveling agent, an anti-foam agent which are used conventionally can be added into said rubber elastic cement in suitable amount, if necessary.

The elastic mortar and the polymer mortar described in the above can be easily obtained by mixing the rubber elastic cement produced as described in the above with the aggrigate and water and particularly, the polymer mortar can be obtained according to the blending defined in JIS standard. For example, in the working of the floor which is applied a relatively large load, large strength and wear characteristics have need to apply in proportion to the load withstand to said large load, so that the aggregate is mixed preferably in excess amount that the rubber elastic cement. For example, the aggregate can be mixed in an amount about 2~3 times the elastic cement blend (that is, about 200~300 weight parts). Whereas, in the waterproof working of a floor which will be not applied the large load or a vessel (for example, water vessel), or in the waterproof-antimoisture working of a storehouse or in the waterproof working in the cold land which will be easily produced the crazing, the aggregate can be mixed in a relatively small ratio than the elastic cement blend, for example in about 30~70 weight parts per 100 weight parts of said elastic cement blend.

The aggregate can be used various kinds of aggregate such as sand, silica sand, perlite, asbestos, glass fiber, calcium carbonate, rubber powder and the like.

When producing the elastic mortar, water is added in an amount suitable to the aggregate to obtain a consistency suitable to the waterproof working. For example, water can be added in an amount of about 30~60 weight parts based on total weight parts of the elastic cement blend and aggregate.

If necessary, the elastic mortar can be added wherein, for example a curing accelerator such as aluminum chloride and aluminum hydride; a delaying agent such as sodium fluoride, sodium gluconic acid and acrylic acid; and a thicking agent such as methyl cellulose and polyisocyanate in an amount suitable to increase the waterproof working properties.

The above mentioned rubber elastic cement and elastic mortar can be produced easily by adding slowly the synthetic resin—or the synthetic rubber-emulsion into the above mentioned amount of cement while stirring with the use of a suitable mixer and mixing intimately these components. In this case, although the viscosity of the elastic mortar influences on the blending amount of the aggregate, such viscosity can be preferably regulated such a manner that water is not added at once and is added slowly little by little until obtained a desire viscosity.

The composite waterproof materials comprising the rubber elastic cement, the elastic mortar and/or polymer mortar layers and having the mesh reinforcing bar layer can be obtained as follows: that is, the above mentioned elastic cement, elastic mortar and/or polymer mortar are deposited on the base surface through the primer in the suitable thickness and then the mesh reinforcing bar is deposited on said deposited layer in a condition without curing said deposited layer by the conventional procedure.

In the deposition, the mesh reinforcing bar is immersed and fixed partially into the cement or mortar material such that said cement or mortar is passed through partially the mesh of the reinforcing bar by the weight of said bar itself and by applying suitable pressure, and alternately the reinforcing bar is fixed temporally on concrete base and the primer by using a strong adhesion rubber tape material or a hot-melt instantaneous adhesive and then deposited the cement or mortar waterproof material on the reinforcing bar to form a waterproof layer having the mesh reinforcing bar layer according to the present invention.

The reinforcing bar used in the present invention includes, for example wire materials such as iron, zine, galvanized iron, chrome, stainless, aluminum and the like. Particularly, in order to able to withstand to the stress when crazed, the mesh reinforcing bar layer should be has a strength of 70 $Kg/cm^2$ at all and a strength more than 5 Kg per one bar. Thus, the thickness of said bar is about 0.1~2 mm, preferably 0.2~0.6 mm and the width of the mesh is about 0.5~5 mm. In case that the bar is very thin, a sufficient strength per one bar can not be obtained, so that a sufficient trength can not be applied to the waterproof layer. Whereas, in case that the bar is very thickness, the strength increases, but the waterproof layer becomes thicker more than the necessary for coating completely the mesh reinforcing bar and becomes expensive in the waterproof working. Also, the width of meshes is preferably less than 5 mm, because when the width is large more than 5 mm, the crazing is transmitted to an upper side layer portion of the waterproof layer pass through the meshes from the under side cement layer and the primer thereby the crazing will be transited to a direction of the upper side layer. Also, in case that the width of the meshes is small, the waterproof materials of the upper layer can not be reached to the under cement layer and the primer through the meshes and thus can not be obtained a sufficient adhesion between the waterproof materials and the mesh reinforcing bar.

BRIEF DESCRIPTION OF THE DRAWINGS

The invention will now be described in greater detail with respect to the process for the waterproof working according to the invention with reference to the drawing in which

As shown in FIG. 1, a primer 2 is provided on a base 1 to be worked of the structure, a rubber elastic cement layer 3 is applied on said coat 2 in a ratio of at least about 0.3~2 Kg per 1 $m^2$ (thickness: about 0.5~1 mm), and then a mesh reinforcing bar layer 4 (for example, stainless mesh wire: diameter 0.5 mm and mesh width 2 mm) is arranged on said rubber elastic cement layer 3. In this case, the mesh reinforcing bar layer is either pressed temporally on the under side layer by a concrete nail, or is fixed by a tacky adhesion tape or a hot melt-type instantaneous adhesive. In the temporal press, the nail is knocked at a suitable place of a superposed positions of mesh reinforcing bar layer. In addition to this, it can be pressed temporally suitable by using stapler, suitable adhesive mass, both surface adhesion tape and the like.

Figure 1:
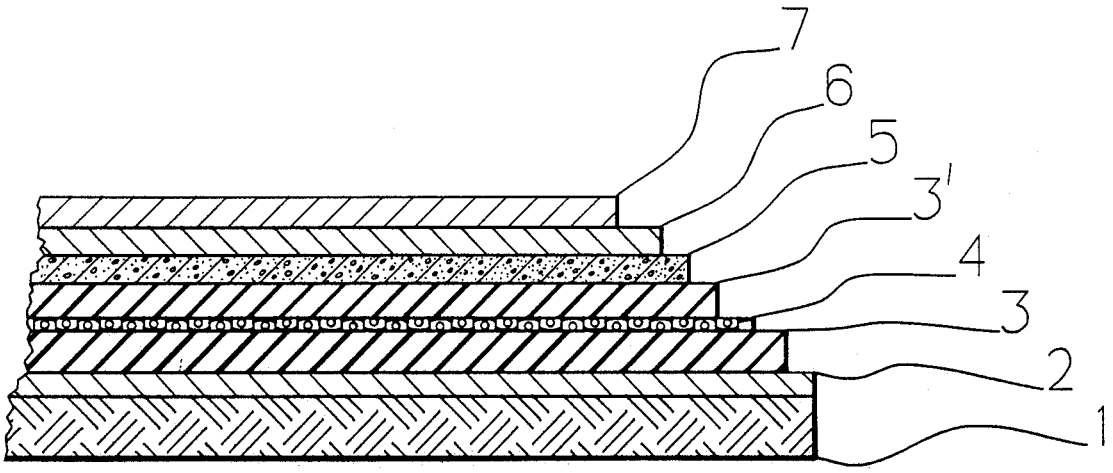
FIG. 1 shows a sectional view of waterproof layer deposited by the waterproof working according to the process of the present invention, and FIG. 2 shown a sectional view of other waterproof layer construction deposited by changing the sequence of the deposition layer.

The same rubber elastic cement layer 3' is further deposited on the reinforcing bar layer 4 temporally pressed as shown in the above in a ratio of at least about 5.0~10 Kg per 1 $m^2$ (thickness: about 3~6 mm). Then, the elastic mortar layer or the polymer mortar layer 5 is deposited on the layer 3' at least about 2~5 Kg (thickness: about 1.5~3 mm) per 1 $m^2$.

By providing the mesh reinforcing bar layer 4 as mentioned the above, the crazing rised in the under side concrete base and the primer can be restrained to reach said crazing to the upper side layer portion of the waterproof layer, while the reinforcing layer can be applied a mechanical strength to the waterproof layer itself and can be also maintained the waterproof layer in uniform thickness.

The deposition of the waterproof materials of the rubber elastic cement, elastic mortar and polymer mortar can be carried out by using the conventional manner of either brush, roller, rubber spatula and the like, or airless spray, mortar gun and the like in the spray painting.

After applied the waterproof material layer, said layer can be dried in the order of about 3~12 hours and usually about 3~6 hours depending to conditions, for example a relationship to backing, weather, humidity, temperature, moist, as well as mixing amount of aggregate and thickness of applied layer and the like.

If necessary, a finished layer 6 comprising the same mortar as the layer 5 can be provided on the layer 5 and further provided on the finished layer 6 a top coat 7 having wear resistance and chemical resistance.

Figure 2:
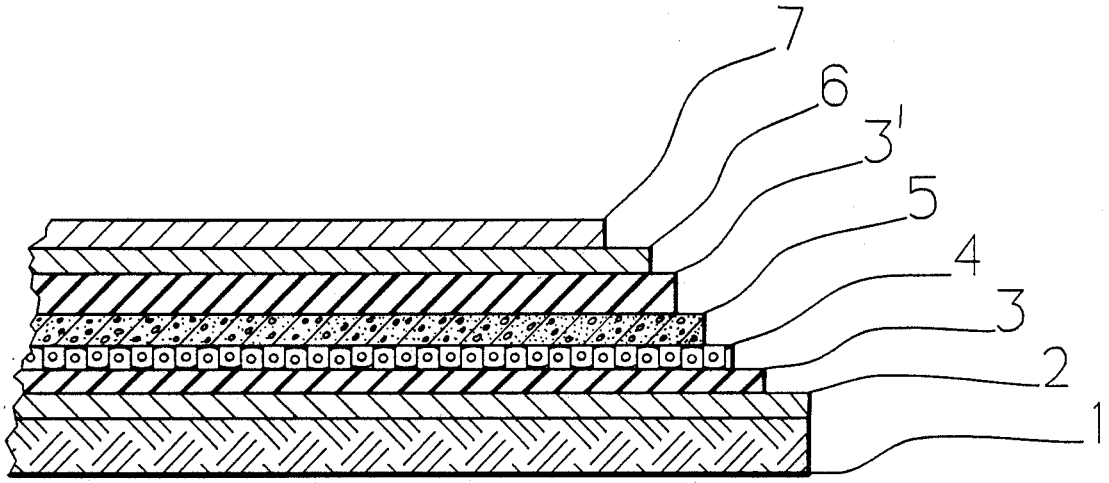

Furthermore, according to the present invention, the mesh reinforcing bar layer can be provided on the elastic mortar and can be provided directly on the mesh reinforcing layer 4 the above elastic mortar or polymer mortar layer 5. As mentioned the above, the order of deposition of each layer can be changed as shown in FIG. 2. However, in a preferable combination of the deposition layer, a first waterproof material layer can be arranged at the under side portion of the mesh reinforcing bar layer, and in other combination, the mesh reinforcing bar layer can be fixed directly over the under cement and mortar layers to deposite sufficiently the waterproof materials thereby said waterproof materials can be deposited sufficiently within the meshes of the reinforcing layer to obtain a complete waterproof layer, and as the result, the resulting waterproof layer can be bonded strongly to the concrete structure.

The following examples are shown for the purpose of illustration only and should not be deemed as limiting the scope of the invention.

EXAMPLE 1

(A) A rubber elastic cement used in this example was produced as follows

About 60~100 by weight parts of water was intimately with 100 by weight parts of acrylic resin by using suitably mixer while stirring to obtain an aqueous dispersed emulsion of acrylic resin.

Then, 100 and 70 by weight parts of portland cement, respectively were mixed with 100 by weight parts of the emulsion such as obtained to produce two rubber elastic cement. From these rubber elastic cement were formed two cement plates having a thickness of 2.0 mm. Physical properties of these plate were determined and there results were shown in Table 1.

TABLE 1

| Mix (Wt. Parts) | | | | Temp. (°C.) | | | | |
|---|---|---|---|---|---|---|---|---|
| No. | Resin | Cement | Physical properties | 60 | 40 | 20 | 0 | −10 |
| 1 | 100 | 100 | Tensile strength ($kg/cm^2$) | 4 | 7 | 11 | 20 | 49 |
| | | | Extension (%) | 260 | 490 | 580 | 190 | 41 |
| 2 | 100 | 70 | Tensile strength ($kg/cm^2$) | — | 5 | 8 | 18 | 28 |
| | | | Extension (%) | — | 700 | 1080 | 660 | 150 |

As shown in Table 1, a cement plate containing no acrylic resin (reference plate) has not substantially the tensile strength, but the elastic cement according to the present invention has an excellent physical properties.

Then, test pieces for cold-bend test were prepared by applying the rubber elastic cement (thickness : 10 mm) as the above mentioned on a galvanized sheet iron (180×90×0.3 mm), and then bend tests (on 180° bend) with regard to these test pieces were carried out at 0° C. and −20° C., respectively and as the result, it was not recognized any change in these test pieces according to the present invention.

(B) An iron wire-metal mesh (diameter 0.5 mm and mesh width 1 mm) was deposited on a surface of the rubber elastic cement plate obtained in (A) to prepare a waterproof layer comprising mesh reinforcing bar layer according to the present invention. Physical properties with regard to the waterproof layer thus formed were determined and these results were shown in Table 2.

TABLE 2

| Mix No. | Deposition component: Elastic cement (Wt. parts) Resin | Cement | Iron wire Thick. (mm) | Width (mm) | Tensile strength (kg/cm²) Deposited iron wire | No deposited iron wire | Cold-bend (−20° C.) |
|---|---|---|---|---|---|---|---|
| 1 | 100 | 100 | 0.5 | 1.0 | 350 | 11 | No change |
| 2 | 100 | 70 | 1.0 | 2.0 | 500 | 8 | No change |

As whown in Table 2, the tensile strength of the waterproof layer including the iron wire as the mesh reinforcing bar was high more than of the layer no including the iron wire, and had an excellent extensibility. Thus, the waterproof layer formed by the waterproof working according to the present invention can be withstood sufficient to the crazing of the concrete floor of the building.

EXAMPLE 2

(A) An elastic mortar was produced as follows 100 and 30 weight parts, respectively of silica sand and 60 weight parts of water were mixed intimately in 100 weight parts of the rubber elastic cement corresponding to the mix No. 1 obtained in Example 1 while stirring.

Mortar plates (thickness 2.0 mm) were formed from the elastic mortar thus obtained and physical properties of these plates were determined. These results were shown in Table 3.

TABLE 3

| No. | Mix (Wt. parts) Resin | Cement | Silica sand | Physical properties | Temp. (°C.) 60 | 40 | 20 | 0 | −10 |
|---|---|---|---|---|---|---|---|---|---|
| 1 | 100 | 100 | 100 | Tensile strength (kg/cm²) | 7 | 9 | 16 | 36 | 76 |
| | | | | Extension (%) | 62 | 110 | 51 | — | — |
| 2 | 100 | 100 | 30 | Tensile strength (kg/cm²) | 5 | 7 | 10 | 18 | 60 |
| | | | | Extension (%) | 180 | 370 | 290 | 95 | 31 |

As the same that described in the example 1, the conventional mortar had not its tensile strength, whereas the elastic mortar according to the present invention had excellently high extension.

(B) An iron wire-metal mesh (diameter 1.5 mm and mesh width 1 mm) was deposited on a surface of the elastic mortar obtained in (A) to prepare a waterproof layer comprising mesh reinforcing bar layer according to the present invention. Then, the physical properties of the waterproof layer thus formed were determined as the same in Example 1 and as the result, were recognized that said waterproof layer had excellent mechanical properties withstood sufficiently to the crazing of the concrete floor.

EXAMPLE 3

The waterproof working according to the present invention was carried out by using polymer mortar (JIS standard) instead of the elastic mortar obtained the example 2 to obtain waterproof layer having excellent physical properties as the same that in the example 2.

What is claimed is:

1. A process for waterproof working of a structure in cold weather to compensate for decreasing elastic modulus down to about −10° C. by increasing the extension percent of a waterproof material using deposition layers and a mesh reinforcing bar layer having a tensile strength of from 70 km/cm² and strength of more than 5 kg per one bar, wherein said bar layer has a mesh width of from about 0.5 to 5 mm, and a thickness of from about 0.1 to 2 mm comprising, depositing on a primer on said structure at least one waterproof material selected from the group consisting of: (1) a rubber elastic cement comprising a mix of a synthetic resin emulsion selected from copolymers of methyl methacrylate-ethyl acrylate, methyl-methacrylate-butylacrylate, methylmethacrylate-2-ethylhexyl acrylate, methylmethacrylate-butadiene, styrene-ethylacrylate and styrene-butylacrylate and cement in a ratio of 1:0.5 to 1:0.7 and (2) an elastic mortar obtained by mixing 100 parts of said rubber elastic cement, 30 parts by weight of silica sand and 60 parts by weight of water; and inserting said mesh reinforcing bar layer in between one of said waterproof deposited layers.

2. A process as claimed in claim 1, wherein said mesh reinforcing bar is selected from materials consisting of iron, galvanized iron, chrome and aluminum.

* * * * *